US005157187A

United States Patent [19]

Le et al.

[11] Patent Number: 5,157,187

[45] Date of Patent: Oct. 20, 1992

[54] HYDROISOMERIZATION PROCESS FOR POUR POINT REDUCTION OF LONG CHAIN ALKYL AROMATIC COMPOUNDS

[75] Inventors: Quang N. Le, Cherry Hill; Stephen S. Wong, Medford, both of N.J.

[73] Assignee: Mobil Oil Corp., Fairfax, Va.

[21] Appl. No.: 636,828

[22] Filed: Jan. 2, 1991

[51] Int. Cl.[5] ..... C07C 5/22; C10G 35/00; C10G 35/06

[52] U.S. Cl. ..... 585/481; 585/482; 208/134; 208/137; 208/138; 208/141

[58] Field of Search ..... 585/481, 482; 208/134, 208/137, 138, 141

[56] References Cited

U.S. PATENT DOCUMENTS

| | | | |
|---|---|---|---|
| 3,409,686 | 11/1968 | Mitsche | 585/481 |
| 4,245,130 | 1/1981 | Jones et al. | 585/481 |
| 4,547,283 | 10/1985 | Neel et al. | 208/46 |
| 4,612,108 | 9/1986 | Angevine et al. | 208/111 |

*Primary Examiner*—Anthony McFarlane
*Assistant Examiner*—Nhat Phan
*Attorney, Agent, or Firm*—Alexander J. McKillop; Charles J. Speciale; Edward F. Kenehan, Jr.

[57] ABSTRACT

There is provided a method for reducing the pour point of an alkyl aromatic lube base stock by hydroisomerizing alkyl side groups on alkyl aromatic compounds. The alkyl aromatic, compounds may be alkylated naphthalenes. The hydroisomerization reaction may take place over a catalyst comprising zeolite beta and platinum.

17 Claims, No Drawings

HYDROISOMERIZATION PROCESS FOR POUR POINT REDUCTION OF LONG CHAIN ALKYL AROMATIC COMPOUNDS

BACKGROUND

There is provided a method for reducing the pour point of an alkyl aromatic lube base stock by hydroisomerizing alkyl side groups on alkyl aromatic compounds.

Alkylaromatic fluids have been proposed for use as certain types of functional fluids where good thermal and oxidative are required. For example U.S. Pat. No. 4,714,794 (Yoshida) describes the monoalkylated naphthalenes as having thermal and oxidative stability, low vapor pressure and flash point, good fluidity and high heat transfer capacity and other properties which render them suitable for use as thermal medium oils. The use of a mixture of monoalkylated and polyalkylated naphthalenes as a base for synthetic functional fluids is described in U.S. Pat. No. 4,604,491 (Dressler) and Pellegrini U.S. Pat. No. 4,211,665 and 4,238,343 describe the use of alkylaromatics as transformer oils.

The alkylated naphthalenes are usually produced by the alkylation of naphthalene or a substituted naphthalene in the presence of an acidic alkylation catalyst such as a Friedel-Krafts catalyst, for example, an acidic clay as described in Yoshida U.S. Pat. No. 4,714,794 or Dressler U.S. Pat. No. 4,604,491 or a Lewis acid such as aluminum trichloride as described in Pellegrini U.S. Pat. No. 4,211,665 and 4,238,343. The use of a catalyst described as a collapsed silica-alumina zeolite as the catalyst for the alkylation of aromatics such as naphthalene is disclosed in Boucher U.S. Pat. No. 4,570,027. The use of various zeolites including intermediate pore size zeolites such as ZSM-5 and large pore size zeolites such as zeolite L and ZSM-4 for the alkylation of various monocyclic aromatics such as benzene is disclosed in Young U.S. Pat. No. 4,301,316.

SUMMARY

There is provided a method for reducing the pour point of a lube base stock comprising alkyl aromatic compounds, said method comprising subjecting said alkyl aromatic compounds to hydroisomerization conditions sufficient to isomerize alkyl side chains on said alkyl aromatic compounds.

EMBODIMENTS

The hydroisomerization process may use moderate to high hydrogen pressures (200 to 3000 psig), temperatures ranging from 150° C. (450° F.) to 454° C. (850° F.), and liquid hourly space velocites (LHSVs) ranging from 0.05 to 10 $hr^{-1}$. Hydrogen circulation rates may range from 500 to 10,000 scf $H_2$/BBL.

The hydroisomerization catalyst used in the present process comprises a refactory oxide material and a hydrogenation component. The hydrogenation component may be a Group VIII element, i.e., Fe, Co, Ni, Ru, Rh, Pd, Os, Ir or Pt. Such catalysts, which contain noble metals, especially, Pt, are preferred.

Another component of the hydroisomerization catalyst may be a zeolite. Examples of such zeolites include zeolite beta, zeolite X, zeolite Y and mordenite.

The alkyl aromatic compounds which are subjected to hydroisomerization conditions may comprise alkyl side chains having at least 10 carbon atoms bonded to a monocyclic or polycyclic aromatic group. Examples of such alkylated aromatics include alkylated naphthalenes with alkyl side groups having at least 12 carbon atoms.

The hydroisomerization catalyst can be shaped into a wide variety of particle sizes. Generally speaking, the particles can be in the form of a powder, a granule, or a molded product such as an extrudate having a particle size sufficient to pass through a 2 mesh (Tyler) screen and be retained on a 400 mesh (Tyler) screen. In cases where the catalyst is molded, such as by extrusion, the catalyst can be extruded before drying or partially dried and then extruded.

It may be desired to incorporate the catalyst with another material which is resistant to the temperatures and other conditions employed in the hydroisomerization process described herein. Such materials include active and inactive materials and synthetic or naturally occurring zeolites as well as inorganic materials such as clays, silica and/or metal oxides such as alumina. The latter may be either naturally occurring or in the form of gelatinous precipitates or gels including mixtures of silica and metal oxides. Inactive materials suitably serve as diluents to control the amount of conversion so that hydroisomerization products can be obtained economically and orderly without employing other means for controlling the rate of reaction. These materials may be incorporated into naturally occurring clays, e.g., bentonite and kaolin, to improve the crush strength of the catalyst under commercial operating conditions. Said materials, i.e., clays, oxides, etc., function as binders for the catalyst. It is desirable to provide a catalyst having good crush strength because in commercial use, it is desirable to prevent the catalyst from breaking down into powder-like materials. These clay binders have been employed normally only for the purpose of improving the crush strength of the catalyst.

Naturally occurring clays which can be composited with catalysts include the montmorillonite and kaolin family, which families include the subbentonites, and the kaolins commonly known as Dixie, McNamee, Ga. and Fla. clays or others in which the main mineral constituent is halloysite, kaolinite, dickite, macrite, or anauxite. Such clays can be used in the raw state as originally mined or initially subjected to calcination, acid treatment or chemical modification. Binders useful for compositing with layered materials also include inorganic oxides, notably alumina.

In addition to the foregoing materials, the catalysts can be composited with a porous matrix material such as silica-alumina, silica-magnesia, silica-zirconia, silica-thoria, silica-beryllia, silica-titania as well as ternary compositions such as silica-alumina-throia, silica-alumina-zirconia, silica-alumina-magnesia and silica-magnesia-zirconia.

The relative proportions of finely divided catalyst and inorganic oxide matrix vary widely, with the layered material content ranging from about 1 to 90 percent by weight and more usually, particularly when the composite is prepared in the form of beads, in the range of about 2 to about 80 weight of the composite.

In the Examples which follow, when Alpha Value is reported, it is noted that the Alpha Value is an approximate indication of the catalytic cracking activity of the catalyst compared to a standard catalyst and it gives the relative rate constant (rate of normal hexane conversion per volume of catalyst per unit time). It is based on the activity of the highly active silica-alumina cracking catalyst taken as an Alpha of 1 (Rate Constant=0.016 $sec^{-1}$). The Alpha Test is described in U.S. Pat. No. 3,354,078, in the *Journal of Catalysis,* Vol. 4, p. 527 (1965); vol. 6, p. 278 (1966); and Vol. 61, p. 395 (1980), each incorporated herein by reference as to that description. The experimental conditions of the Alpha Test preferably include a constant temperature of 538° C. and a variable flow rate as described in detail in the Journal of Catalysis, Vol. 61, p. 395.

EXAMPLE 1

This Example illustrates the effect of alpha olefin chain length on the properties of alkylated naphthalene synthetic lube base stocks. Table 1 compares the product properties of monoalkylated naphthalene lubes produced from various alpha linear olefin feedstocks.

TABLE 1

| Alpha Olefin | $\alpha C_{14}=$ | $\alpha C_{18}=$ |
|---|---|---|
| Example | 1A | 1B |
| Product Properties | | |
| Pour Point, °F. | −65 | 0 |
| KV @ 40° C., cSt | 19.69 | 26.77 |
| @ 100° C., cSt | 3.75 | 4.72 |
| VI | 40 | 90 |

Mono-alkylated naphthalene lube produced from alpha $C_{18}$ olefin ($\alpha C_{18}=$) has much higher pour point (0 vs. −65° F.), higher viscosity (26.77 vs. 19.69 cSt 040° C.) and higher viscosity index (90 vs. 40 VI) than that obtained from alpha $C_{14}$ olefin ($\alpha C_{14}=$) feedstock.

EXAMPLE 2

This Example shows the catalytic performance of Pt zeolite beta for improving the pour point of alkylated naphthalene lube base stock. The catalyst used in this experiment is a 65 wt % zeolite beta/35 wt % $Al_2O_3$ extrudate. Prior to the addition of 0.6 wt % Pt, the extrudate was steamed to 55 alpha acidity level. The hydroisomerization experiment was carried out in a 1 L autoclave using mono-$C_{18}$ alkylated naphthalene obtained from Example IB as a feedstock, 4.2 wt % catalyst at 500° F. for 6 hours under a hydrogen pressure of 200 psig. After decanting and filtering the catalyst, the total liquid product was then vacuum distilled at 650° F. to obtain about 67 wt % unconverted alkylated lube. Table 2 compares the product properties of mono-$C_{18}$ alkylated lube before and after processing over Pt zeolite beta catalyst.

TABLE 2

| | Feed | Product |
|---|---|---|
| Example | 1A | 2 |
| Catalyst | None | Pt Zeolite Beta |
| Product Properties: | | |
| Pour Point, °F. | 0 | −35 |
| KV @ 40° C., cSt | 26.77 | 45.86 |
| @ 100° C., cSt | 4.72 | 6.42 |
| VI | 90 | 85 |

The result indicates that Pt zeolite beta effectively decreases the pour point of the mono-alkylated naphthalene from 0° to −35° F. by hydroisomerization of long alkyl side chains. The formation of branched paraffin along the long $C_{18}$ alkyl group is evidenced by the reduction in lube viscosity index from 90 to 85. The side chain isomerization reaction occurs simultaneously with dealkylation reaction and ring saturation. To a lesser extent aromatic disproportination reaction is also observed. This resulted in the formation of di-alkylated aromatic products, leading to an increase in lube viscosity from 26.77 to 45.86 cSt @ 40° C.

What is claimed is:

1. A method for reducing the pour point of a lube base stock comprising alkyl aromatic compounds, said method comprising subjecting said alkyl aromatic compounds to hydroisomerization conditions sufficient to isomerize alkyl side chains on said alkyl aromatic compounds.

2. A method according to claim 1, comprising contacting said lube base stock with a hydroisomerization catalyst comprising a hydrogenation metal supported on a refractory oxide material.

3. A method according to claim 2, wherein said hydroisomerization catalyst comprises a zeolite.

4. A method according to claim 3, wherein said zeolite is selected from the group consisting of zeolite beta, zeolite X, zeolite Y and mordenite.

5. A method according to claim 2, wherein said hydrogenation metal is a noble metal.

6. A method according to claim 5, wherein said noble metal is platinum.

7. A method according to claim 1, wherein said hydroisomerization conditions include a hydrogen pressure of from 200 psig to 3000 psig, a temperature of from 150° C. to 454° C., a liquid hourly space velocity of from 0.05 $hr^{-1}$ to 10 $hr^{-1}$ and a hydrogenation circulation rate of from 500 scf $H_2$/BBL to 10,000 scf $H_2$/BBL.

8. A method according to claim 1, wherein said alkyl aromatic compounds comprise alkyl side chains having at least 10 carbon atoms bonded to a monocyclic or polycyclic aromatic group.

9. A method according to claim 1, wherein said alkylated aromatic compounds are alkylated naphthalenes with alkyl side groups having at least 12 carbon atoms.

10. A method according to claim 3, wherein said zeolite is zeolite beta.

11. A method according to claim 10, wherein said hydroisomerization conditions include a hydrogen pressure of from 200 psig to 3000 psig, a temperature of from 150° C. to 454° C., a liquid hourly space velocity of from 0.05 $hr^{-1}$ to 10 $hr^{-1}$ and a hydrogenation circulation rate of from 500 scf $H_2$/BBL to 10,000 scf $H_2$/BBL.

12. A method according to claim 11, wherein said hydrogenation metal is platinum.

13. A method according to claim 12, wherein said alkylated aromatic compounds are alkylated naphthalenes with alkyl side groups having at least 12 carbon atoms.

14. A method according to claim 1 comprising contacting said lube base stock with a hydroisomerization catalyst comprising platinum and zeolite beta.

15. A method for reducing the pour point of a lube base stock comprising alkyl aromatic compounds, said aromatic compounds comprising alkyl side chains having at least 10 carbon atoms bonded to monocyclic or polycyclic aromatic groups, said method comprising contacting said lube base stock with a hydroisomerization catalyst under hydroisomerization conditions sufficient to cause branching of said alkyl side chains on said alkyl aromatic compounds.

16. A method according to claim 15, wherein said hydroisomerization catalyst comprises platinum and zeolite beta.

17. A method according to claim 15, wherein said lube base stock is prepared by alkylating naphthalene with a linear alpha olefin feedstock.

* * * * *